United States Patent [19]

Ueda et al.

[11] Patent Number: 4,963,929

[45] Date of Patent: Oct. 16, 1990

[54] CLEANING DEVICE FOR TONER DETECTING SENSOR

[75] Inventors: Masahide Ueda; Masao Tokumoto, both of Osaka, Japan

[73] Assignee: Minolta Camera Kabushiki Kaisha, Osaka, Japan

[21] Appl. No.: 478,740

[22] Filed: Feb. 9, 1990

Related U.S. Application Data

[63] Continuation of Ser. No. 227,991, Aug. 3, 1988, abandoned.

[30] Foreign Application Priority Data

Aug. 5, 1987 [JP] Japan ..... 62-195626
Aug. 5, 1987 [JP] Japan ..... 62-195627

[51] Int. Cl.[5] ..... G03G 21/00

[52] U.S. Cl. ..... 355/215; 118/691; 355/246; 355/299

[58] Field of Search ..... 355/200, 210, 215, 246, 355/296, 299; 118/652, 689, 690, 691; 15/256.5, 256.52

[56] References Cited

U.S. PATENT DOCUMENTS 3,778,146 12/1973 Knapp ..... 118/691 X
3,859,691 1/1975 Katayama et al. ..... 355/299 X
3,940,282 2/1976 Hwa ..... 355/299 X
4,134,673 1/1979 Fisher ..... 355/301
4,202,437 5/1980 Gordon ..... 15/256.5 X
4,361,922 12/1982 Karal ..... 355/303 X
4,621,386 11/1986 Hill ..... 15/256.5 X
4,711,551 12/1987 Fujio et al. ..... 355/245 X
4,768,062 8/1988 Tanzawa et al. ..... 355/298

FOREIGN PATENT DOCUMENTS 56-148017 11/1981 Japan .

*Primary Examiner*—Fred L. Braun
*Attorney, Agent, or Firm*—Burns, Doane, Swecker & Mathis

[57] ABSTRACT

A toner cleaning device for a toner detecting sensor for cleaning toner without scratching the surface of area to be detected. Two sheets of blades in two different length, one being shorter than the other, are atached to a rotating shaft for cleaning toner. A first blade does not reach the surface of the sensor but removes most of the toner accumulated on the surface to be detected except the toner in the area closely contacted with the surface, while a second blade contacts slidably and softly with the surface to be detected thereby removeing the toner accumulated thereon.

22 Claims, 5 Drawing Sheets

CLEANING DEVICE FOR TONER DETECTING SENSOR

This application is a continuation of application Ser. No.227,991, filed Aug. 3, 1988, now abandoned.

BACKGROUND OF THE INVENTION

The present invention relates to a cleaning device for toner detecting sensor for use in an electrophotographic copying machine, printer and the like.

In a copying machine and the like, toner detecting sensors which detect toner density and emptiness of toner in a toner containing chamber are disposed in a toner transporting section or the toner containing chamber, however, when toner is accumulated on and adhered to the surface of the toner detecting sensor, accurate toner detection can not be carried out. In order to solve the problem, a device which is equipped with a cleaning elastic plate or cleaning brush attached to a rotating shaft so as to clean the surface of the toner detecting sensor by slidably contacting with the sensor in correlative movement with rotation of the rotating shaft is well known.

For example, there is disclosed a cleaning device in Japanese Published Unexamined Patent Application No. 148017/1981 which removes toner accumulated on the surface of a toner detecting sensor by a brush attached to a rotating shaft. However, in the conventional device, cleaning elastic plates and brushes slidably contact with the surface of the toner detecting sensor and the surface of sensor is scratched and scraped off. And, as a result, it can not be endured for use of long duration, and moreover, normal detection can not be carried out since the distance between the detecting part of the sensor and the toner to be detected is varied because of toner accumulation.

SUMMARY OF THE INVENTION

The main object of the present invention is to provide a cleaning device for toner detecting sensor which is capable of cleaning fully the toner accumulated on the surface of toner detecting sensor while eliminating such problem as scratching and scraping off the surface of detecting sensor.

In order to accomplish the object, the cleaning device for toner detecting sensor of the present invention is equipped with a shaft, a first blade and a second blade. With such structure, only the second blade slidably contacts with the surface of toner detecting sensor correlatively with rotation of the shaft avoiding any problem of scratching and scraping off the surface of detecting sensor since the second blade is made long in length so that it contacts the surface of sensor softly. Most of the toner accumulated on the surface to be detected is removed by the first blade directly excepting the portion in close contact, and the toner accumulated thereon is removed by the second blade which is backed up by the function of first blade. The first blade is made so short in length that its shape is not transformed even if it is used for long duration of time thereby removing toner as much as possible at all times. The second blade may remove only the toner on the surface to be detected which is closely contacted with and is able to fully clean the surface even if the bending stiffness is small.

Further objects and features of the present invention will be apparent from the following description, reference being had to the accompanying drawing wherein preferred embodiments of the present invention are clearly shown.

DETAILED DESCRIPTION OF THE INVENTION

Preferred embodiment of the present invention will be described with reference to the accompanying drawings.

Figure 1:
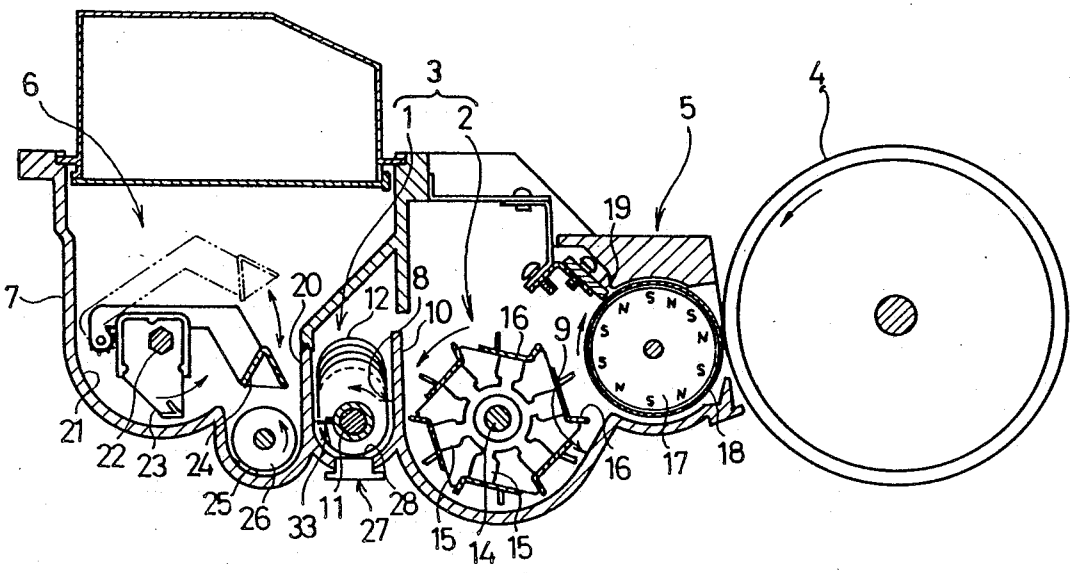
FIG. 1 is a vertical side view showing the first embodiment to which a cleaning device of the present invention is applied.
Figure 2:
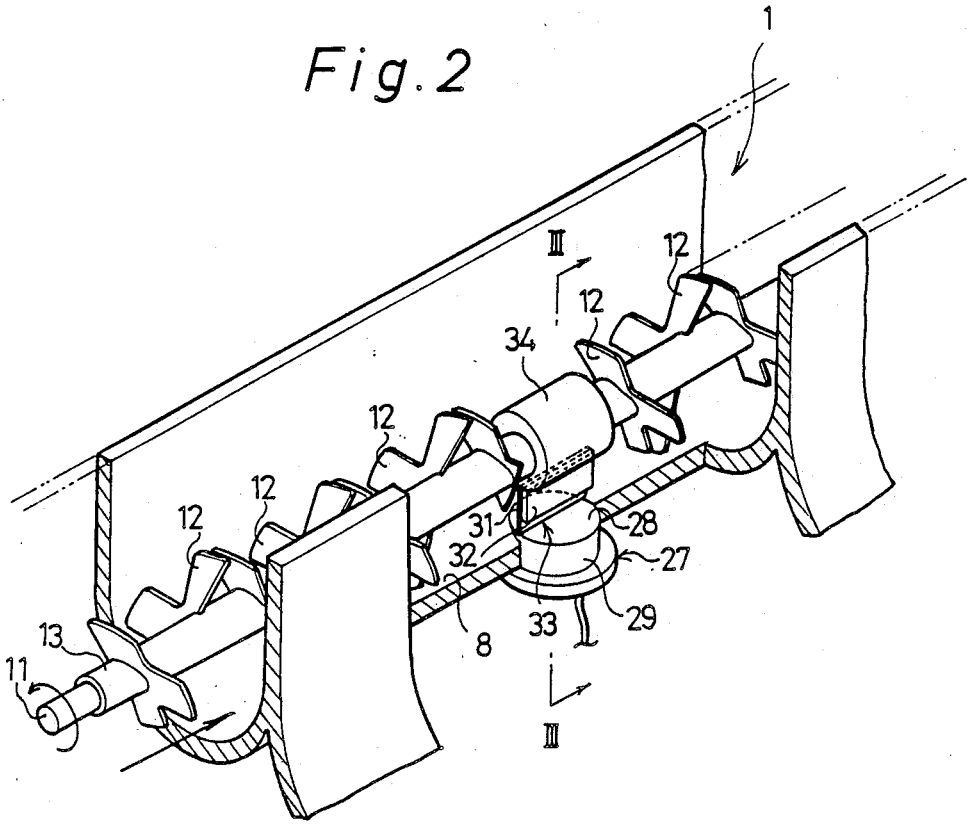
FIG. 2 is a perspective view showing the main part of cleaning device.
Figure 3:
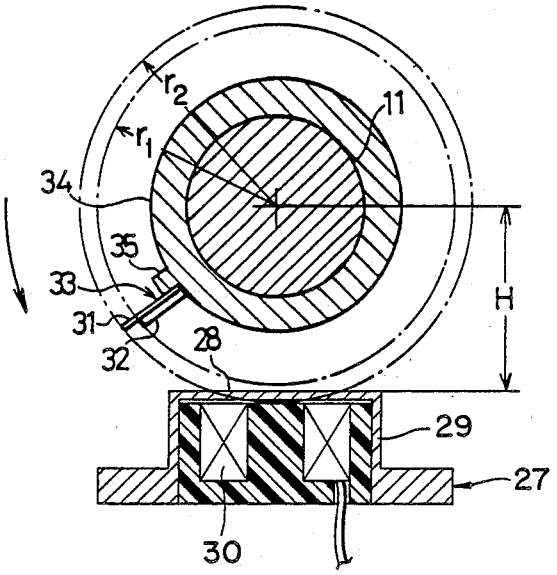
FIG. 3 is a section taken on line III—III in FIG. 2.

FIGS. 1 through 3 show the first embodiment of the present invention to which a developing unit of a copying machine is applied.

The developing unit is comprised of developer transport section 3 in which a developer composed of two dual materials of insulative toner and magnetic carrier mixture is stirred and transported between a first transport section and a second transport section in circulation, developing section 5 in which developer is transported from the developer transport section 3 to a photosensitive drum 4 and toner containing chamber 6 which replenishes toner to the developer transport section 3.

The first and second transport sections 1,2 include a first and second semi-cylindrical transport path 8,9 in the bottom of a casing 7 and isolated by a partition 10 having two communicating sections (not shown) in front and back side of FIG. 1.

At the first transport section (toner transport section) 1, a rotating shaft 11 is disposed along the first transport path 8, and a plurality of rotating vanes 12 are attached to the rotating shaft 11 through a support member 13. The rotating vanes convey developer from the front to the back side along the transport path 8 with correlative rotation of the rotating shaft 11.

At the second transport section 2, rotating vanes 15 which stir and convey developer from back to front side and buckets 16 for transporting developer to the developing unit are equipped with rotating shaft 14 which is disposed along the second transport path 9.

The developing unit 5 is provided with a magnetic roller 17 for adsorbing developer, developing sleeve 18 which is positioned and rotating around periphery of the magnetic roller 17 and height regulating member 19 for regulating the height of developer. Toner containing chamber 6 for replenishing toner is partitioned from the first transport section 1 by a partition 20. Inside a toner hopper 21 formed in the casing 7, stirring member 23 for stirring toner a detecting device 24 for detecting emptiness or lack of toner in toner containing chamber and a screw conveyer 26 for replenishing toner accommodated in a replenishing groove 25 formed at the bottom of the toner hopper 21 into the first transport section 1 are disposed.

As shown in FIG. 2, a toner density detecting sensor (sensor for detecting toner) 27 is disposed in the first transport path 8. The surface 28 of sensor 27 to be detected is smooth and is positioned at almost the same level with the surface of the transport path 8. The sensor 27 detects the variation of toner density as the variation of magnetic permeability, and outputs the detected value to a control section (not shown), and inner coil 30 is protected by a cover made of nonmagnetic resin 29 thus forming the surface 28 of sensor 27 to be detected as shown in FIG. 3. The cover 29 functions as a spacer for maintaining a certain distance between developer and inner coil 30 when magnetic permeability of developer is measured.

At the part where the rotating shaft 11 is positioned opposite to the sensor 27, a cleaning elastic plate 33 is comprised of a short sized first blade 32 and long sized second blade 31 and are disposed extending in the radial direction. Designated by numeral 34 is a regulating member for regulating the amount of toner flow and 35 is a position where the cleaning elastic plate 33 is attached thereto. The cleaning elastic plate 33 is made of polyester film. The second blade 31 has a thickness of 0.05 mm and small bending stiffness positioned at the back side with respect to the rotating direction. The first blade 32 has a thickness of 0.1 mm and large bending stiffness positioned at the front side with respect to the rotating direction. The blades are laid on top of one another.

With respect to the center of the axial core of the rotating shaft 11, the radius of the second blade 31 is set as $r_2$, the radius of the first blade 32 as $r_1$ and the distance to the surface 28 as H. The relationship among them is: $r_2 > H > r_1$ as shown in FIG. 3. Accordingly, only the second blade 31 slidably contacts the detecting surface 28 in correlative rotation with the rotating shaft 11, while the first blade 32 does not contact the surface 28 though it approaches thereto. The cleaning elastic plate 33 is thus able to remove the developer accumulated on the sensor 27 by correlative movement with the rotating shaft 11 firstly with the first blade 32 whose bending stiffness is large enough to remove a large amount of developer. At this time, the first blade 32 neither scratches nor scrapes off the surface 28 of the detecting sensor since it does not contact with the surface 28.

Then, the tip portion of the second blade 31 removes the toner on the detecting sensor 27 by slidably contacting with the surface. Most of the developer had already been removed by the first blade 32 at this time, and therefore, even though the bending stiffness is small, the removal of toner can be carried out fully since the developer left on the surface 28 is a small amount.

As the bending stiffness of the second blade 31 is small and the second blade 31 is positioned at the rear side of the first blade 32 in the rotating direction, the second blade 31 bends about the attaching position 35 in a direction opposite to the rotating direction of the regulating member 34, and contacts softly with the surface 28 thus advantageously avoiding scratching and scraping off the surface 28 of the detecting sensor. By so cleaning the surface 28 of the detecting sensor 27, toner density detection for newly replenished developer can be carried out thereby maintaining the toner density at a predetermined value by replenishing proper amounts of toner from the toner containing chamber to the first transport section 1 according to the value detected.

Figure 4:
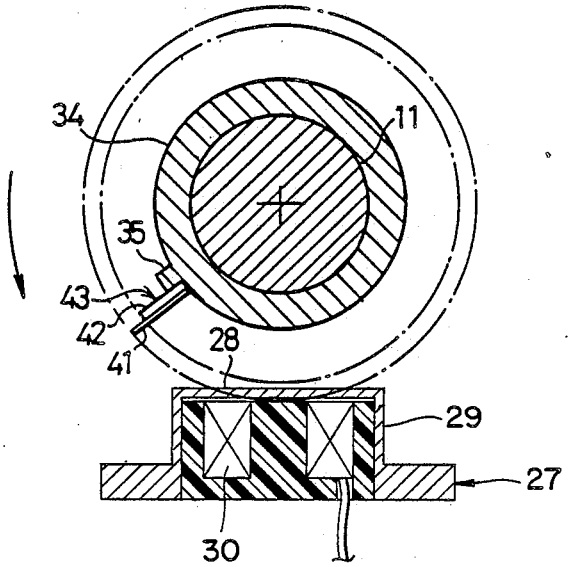
FIG. 4 is a vertical side view showing the main part of the second embodiment of the present invention.

The second embodiment of the present invention to which a developing unit of a copying machine is applied will now be described with reference to FIG. 4.

In the embodiment, a cleaning elastic plate 43 comprises a long blade and a short blade, that is, a second blade 41 whose bending stiffness is small and a first blade 42 whose bending stiffness is large, by which the developer on the surface of a toner density detecting sensor 27 is cleaned just the same as the one disclosed in the first embodiment. However, there is a difference in that the second blade 41 is disposed in front of the first blade 42 in the direction of rotation. According to this embodiment, when the second blade 41 moves slidably across the surface 28 of the sensor 27 correlatively with the rotation of the rotating shaft 11, it can remove most of the large amount of developer accumulated on the sensor 27 by the backup of the first blade 42 positioned behind whose bending stiffness is large. The tip portion of the second blade 41 which slidably contacts with the surface 28 is not backed up by the first blade 41. Therefore it can easily transform its shape and softly contacts with the surface 28 thereby avoiding any scratches on the surface of the sensor. The other structure of the embodiment is the same as the first embodiment, and therefore, further description will be omitted.

The third and fourth embodiments of the present invention will then be described.

Figure 5:
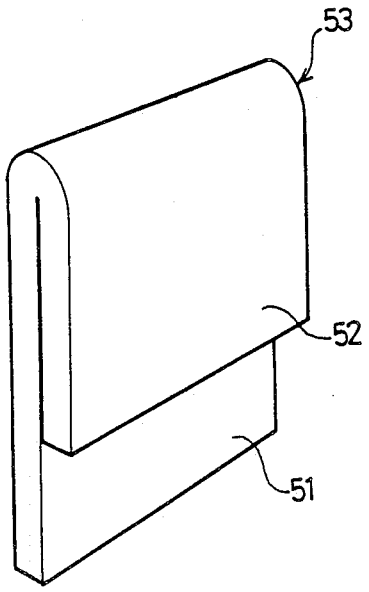
FIG. 5 is a perspective view showing a portion of blade in the third embodiment of the present invention.

In place of the cleaning elastic plate 33 as shown in the first embodiment, a cleaning elastic plate 53 as embodied in the third embodiment may be used. As illustrated in FIG. 5, a sheet of elastic plate is folded back so as to have one end projecting a longer distance from the other end. The longer portion is designated as a second blade and shorter portion as a first blade thereby forming a cleaning elastic plate 53. In this case, the first blade 52 is placed in front and the second blade 51 at the back in the direction of rotation.

Figure 6:
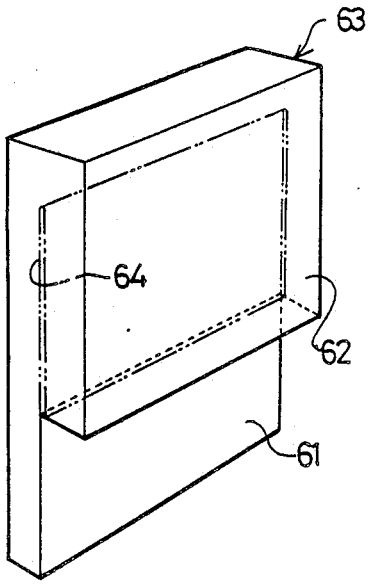
FIG. 6 is a perspective view showing a portion of blade in the fourth embodiment of the present invention.

Instead of the cleaning elastic plate 33 as shown in the first embodiment, a cleaning elastic plate 63 comprised of a second blade 61 and a first blade 62 in one body may also be utilized as illustrated in FIG. 6 for the fourth embodiment of the present invention. In this case, the first blade 62 comes in front in the direction of roation and the second blade at the back. The thickness of the second blade and the first blade may be determined in consideration of the elasticity of the material and the radial length when attached to a rotating transport shaft.

Further, the positions of the cleaning elastic plates 53,63 in the direction of rotation applied in the third and fourth embodiments may be changed conversely. In other words, the second blades 51,61 used in the third and fourth embodiments may be positioned in front in the direction of rotation and the first blades 52,62 at the back side. The cleaning elastic plate 63 as shown in the fourth embodiment of the present invention may also be provided with a slit as illustrated by phantom line in FIG. 6.

Figure 7:
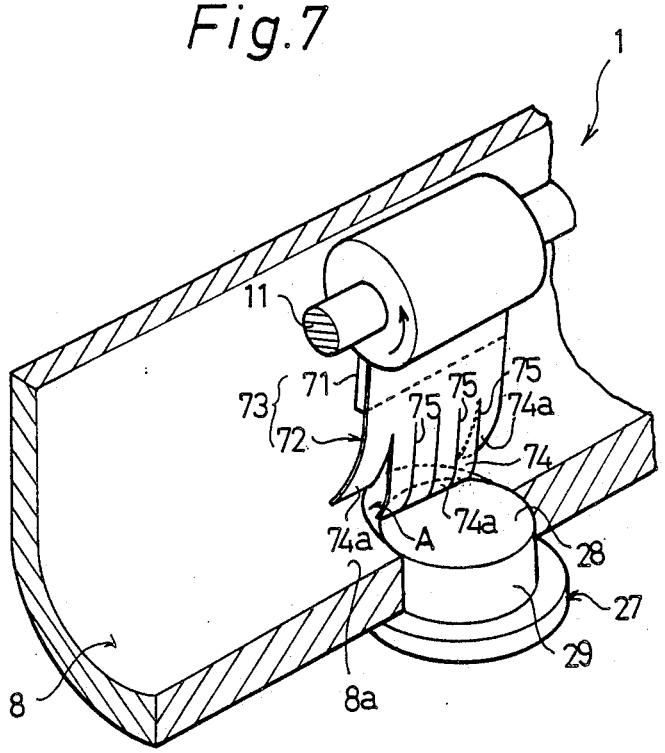
FIG. 7 is a perspective view showing the main part of the fifth embodiment of the present invention.

FIG. 7 shows the fifth embodiment of the present invention. A tip portion 74 of a second blade is divided by a plurality of slits 75 in the direction of width and so as to provide a plurality of cleaning tips 74*a*. A cleaning elastic plate 73 is comprised of a first blade 72 and a second blade 71. In the embodiment, as illustrated in FIG. 7, a sensor 27 is disposed in a first transport path 8, and it may be preferably utilized when there is a difference in level A between the surface 28 of the sensor 27 and the base 8*a* of the curved surface in the transport path 8. In other words in the area A, the cleaning tips 74*a* positioned at the end of portion 74 are elastically movable with slidable contact with the base 8*a* in the transport path 8, so that the cleaning tips 74*a* positioned in the middle of the tip portion 74 recovers independently from other cleaning tips 74*a* by its elasticity, and is able to slidably contact with the surface 28 to be detected. Thus, the toner accumulated on the surface 28 in the area A can be removed and accurate detection can be carried out.

The present invention can be applied to a cleaning device which is provided with a toner density detecting sensor besides toner transport sections 1,2 described in the embodiment. It may also be applied to a cleaning device which is provided with a toner density detecting sensor by utilizing light sensor besides the magnetic sensor utilized in the embodiments of the present invention. Such material as artificial leather which possess proper elasticity may be used for the first and second blades besides such synthetic resin as polyester. Further, each blade may be formed of a different material. For example, the first blade which is out of contact with the surface of the sensor is made of phosphor bronze while the second blade which is in contact with the surface is made of resin.

What is claimed is:

1. A cleaning device for a toner detecting sensor, comprising:

a rotating shaft disposed to oppose the surface of the toner detecting sensor;

a first blade for cleaning toner disposed in the radial direction to the rotating shaft, having a width in the direction of the shaft, shorter in length than the distance between the rotating shaft and the surface of the sensor and possessing elasticity; and a second blade for cleaning toner disposed adjacent to the first blade in the radial direction to the rotating shaft, having a width in the direction of shaft, longer in length than the distance between the rotating shaft and the surface of the sensor and possessing elasticity.

2. A cleaning device as defined in claim 1, wherein the first blade is positioned at the back side of the second blade in the direction of the rotating shaft.

3. A cleaning device as defined in claim 1, wherein the first blade is positioned at the front side of the second blade in the direction of the rotating shaft.

4. A cleaning device as defined in claim 1, wherein the bending stiffness of the first blade is larger than that of the second blade.

5. A cleaning device as defined in claim 4, wherein said first blade has a thickness greater than that of said second blade and each of said blades is made of the same material.

6. A cleaning device as defined in claim 4, wherein each of said blades is made of different materials.

7. A cleaning device as defined in claim 1, wherein a sheet plate is folded back to have its shorter portion as the first blade and longer portion as the second blade.

8. A cleaning device as defined in claim 1, wherein the first and second blades are formed in one body.

9. A cleaning device as defined in claim 1, wherein a tip portion of the second blade is divided into a plurality of strips.

10. A cleaning device as defined in claim 1, wherein the surface to be detected is facing a toner transport section.

11. A cleaning device as defined in claim 1, wherein the surface to be detected is facing a toner containing chamber.

12. A cleaning device for a toner detecting sensor, comprising:

a rotating shaft disposed oppositely to a detecting surface of the toner detecting sensor, the sensor detecting toner density;

a first elastic blade for cleaning toner disposed in the radial direction to the rotating shaft, having a width in the direction of the shaft and being shorter in length than the distance between the rotating shaft and the surface of the sensor; and a second elastic blade for cleaning toner disposed adjacent to the first blade in the radial direction to the rotating shaft, having a width in the direction of the shaft and being longer in length than the distance between the rotating shaft and the surface of the sensor.

13. A cleaning device as defined in claim 12, wherein the first blade is positioned at the back side of the second blade in the direction of the rotating shaft.

14. A cleaning device as defined in claim 12, wherein the first blade is positioned at the front side of the second blade in the direction of the rotating shaft.

15. A cleaning device as defined in claim 12, wherein the bending stiffness of the first blade is greater than that of the second blade.

16. A cleaning device as defined in claim 12, wherein a sheet plate is folded back to have its shorter portion as the first blade and longer portion as the second blade.

17. A cleaning device as defined in claim 12, wherein the first and second blades are formed in one body.

18. A cleaning device as defined in claim 12, wherein a tip portion of the second blade is divided into a plurality of strips.

19. A cleaning device as defined in claim 12, wherein the surface to be detected faces a toner transport section.

20. A cleaning device as defined in claim 12, wherein the surface to be detected faces a toner containing chamber.

21. A cleaning device as defined in claim 12, wherein said first blade is of a thickness greater than that of said second blade and each of said blades is made of the same material.

22. A cleaning device for a toner detecting sensor, comprising:

a rotating shaft disposed oppositely to a detecting surface of the toner detecting sensor;

a first elastic blade for cleaning toner disposed in the radial direction to the rotating shaft, having a width in the direction of the shaft and being shorter in length than the distance between the rotating shaft and the surface of the sensor;

a second elastic blade for cleaning toner disposed adjacent to the first blade in the radial direction to the rotating shaft, having a width in the direction of the shaft and being longer in length than the distance between the rotating shaft and the surface of the sensor, said cleaning device defined by a sheet of material folded on itself so as to have a short portion as the first blade and a longer portion as the second blade.

* * * * *